United States Patent [19]

Snyder

[11] 4,094,454

[45] June 13, 1978

[54] PARTITIONS WITH RELEASABLE GRIPPING EDGES

[75] Inventor: Herbert Clarke Snyder, Brockway, Pa.

[73] Assignee: Sonoco Products Company, Hartsville, S.C.

[21] Appl. No.: 805,853

[22] Filed: Jun. 13, 1977

[51] Int. Cl.[2] ..... B65D 5/48

[52] U.S. Cl. ..... 229/15; 229/DIG. 11; 229/28 R

[58] Field of Search ..... 229/DIG. 11, 48 SB, 229/15; 217/30

[56] References Cited

U.S. PATENT DOCUMENTS

| | | | |
|---|---|---|---|
| 1,984,609 | 12/1934 | Walker et al. | 229/15 |
| 2,256,024 | 9/1941 | Hill | 229/DIG. 11 |
| 2,744,624 | 5/1956 | Hoogstoel | 229/DIG. 11 |
| 3,011,672 | 12/1961 | Vesak | 217/30 |
| 3,189,244 | 6/1965 | Whalen | 229/15 |
| 3,201,022 | 8/1965 | Glassco et al. | 229/15 |
| 3,322,323 | 5/1967 | Greene et al. | 229/DIG. 11 |
| 3,491,909 | 1/1970 | Ikelheimer | 217/7 |
| 3,536,246 | 10/1970 | Rosen | 229/15 |
| 3,843,039 | 10/1974 | Brown et al. | 229/28 R |
| 3,880,343 | 4/1975 | Rockefeller | 229/28 R |

*Primary Examiner*—Davis T. Moorhead
*Attorney, Agent, or Firm*—Dennison, Dennison, Meserole & Pollack

[57] ABSTRACT

A partition, slidably receivable within a paperboard carton or the like, is provided along one or more edges thereof with a substance capable of effecting a gripping of the partition within the carton, or a separable adherence therebetween, which is sufficient to prevent inadvertent disengagement of the partition from the carton upon inverting of the carton, even when the discharge of the packed carton contents is involved. At the same time the substance used will allow for a physical withdrawal of the partition from the carton without significant damage to either the partition or the carton.

5 Claims, 3 Drawing Figures

PARTITIONS WITH RELEASABLE GRIPPING EDGES

BACKGROUND OF THE INVENTION

The present invention is concerned with partitions of the type normally freely received within cartons, boxes, and the like for a variety of purposes including separation and/or protection of the contents. More particularly, the invention is concerned with the provision of means particularly adapted to prevent an inadvertent discharge of the partition from the associated carton, while at the same time allowing for intentional removal of the partition.

Partitions, for example solid fibre partitions, are frequently used as separators or as an innerpacking in conjunction with cartons to protect, in a cell-like fashion, whatever product may be transported in the carton. A common use for such partitions is in the protection of glass containers, either empty or filled, against breakage and scuffing. In connection with empty glass containers, the filler, that is the one performing the filling operation, will normally purchase the total unfilled package including the empty glass containers packed within a corrugated carton and protected by an internal partition of cellular construction.

The glass containers are initially packed upside down by the glass container manufacturer in anticipation of the automatic decasing operation by the filler. The decasing operation involves an emptying of the glass containers out of the carton for processing through the filling operation. The emptying of the containers is effected by a known automatic operation wherein the carton is picked up mechanically and inverted so that the containers will fall onto a conveyor right side up in preparation for the filling operation. It is during the decasing process that the partition assembly frequently falls out of the carton onto the conveyor along with the containers, thereby disrupting the process of feeding the empty containers into the filling line.

This falling out of the partition results because of the lack of sufficient friction between the inside of the carton and the outside normally vertical edges of the partition. The partition itself is basically composed of several interlocked lengthwise and crosswise strips or panels, the length and width of which can be controlled to relatively fine tolerances, i.e., plus or minus 1/32 inch. The internal dimensions of a corrugated carton are generally controlled to plus or minus ⅛ inch, but can vary as much as plus or minus 3/16 inch to ¼ inch. It is the combination of these tolerances which gives rise to the likelihood of the partitions falling out of the cartons when they are inverted.

In some instances, the partition can be manufactured slightly oversized, that is with the lengthwise and crosswise strips slightly longer than the specified dimensions, thereby creating a tight fit between the partition and the inside of the carton. However, if the inside dimensions of the carton are as specified, or possibly slightly smaller, it can be difficult to insert the partition into the carton or, even if this is accomplished, cell distortion can result due to the necessary bending of the lengthwise or crosswise strips which must be effected if the partition is to be inserted into the carton. This distortion of the cells can, in turn, result in jam-ups on the automatic casing line. That is, when the cartons are being loaded at the container manufacturing installation, the cells in the carton, which are distorted from use of the oversize partition, do not register properly with the automatically dropped containers. This, obviously, can result in difficulties including line stoppage and container breakage.

SUMMARY OF THE INVENTION

It is the specific object of the present invention to modify the outside normally vertical edges of a partition, preferably by the application of an appropriate substance capable of providing a grip between the partition edge and inner surface of the carton, sufficient so as to preclude an accidental discharge of the partition from the carton while at the same time allowing for an intentional removal of the partition when desired. One example of a substance found particularly adaptable for this purpose is Goodrich Chemical Company's Goodrite B-0137 2570X1, which is understood to comprise a styrene butadiene latex. This substance will be coated on an edge or edges of the partition and is of an elastomeric nature and, even when dry, remains tacky and capable of releasably adhering to the inner wall of the carton and developing sufficient shear resistance to prevent the unintentional dropping of the partition from the carton. At the same time, inasmuch as the primary adherence of the substance is to the partition edge or edges, the partition can be easily physically stripped from the carton without damage to the carton such as would affect its reuse.

DESCRIPTION OF PREFERRED EMBODIMENT

Figure 1:
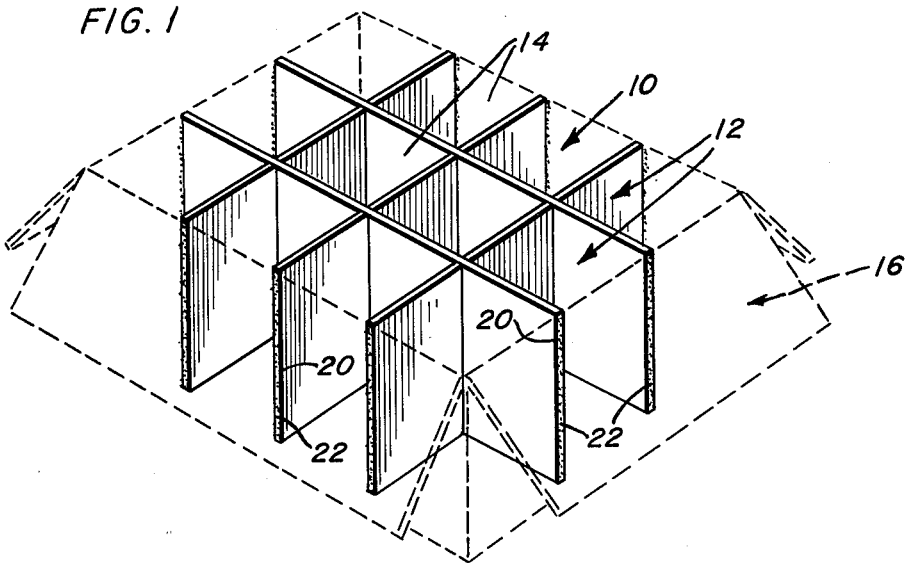
FIG. 1 is a perspective view of a partition in accordance with the present invention, a partition receiving carton being illustrated in phantom lines.

Referring now specifically to the drawings, reference numeral 10 is used to generally designate a partition in accordance with the present invention. This partition 10 is basically of conventional construction, involving crossed interlocking strips or panels 12 defining cells 14 within the partition receiving carton 16. If warranted by the circumstances, the partition can consist of a single planar panel 12. In each instance, the partition panel or panels will, in the basic structure thereof, be planar with coplanar side, top and bottom edge portions.

Figure 2:
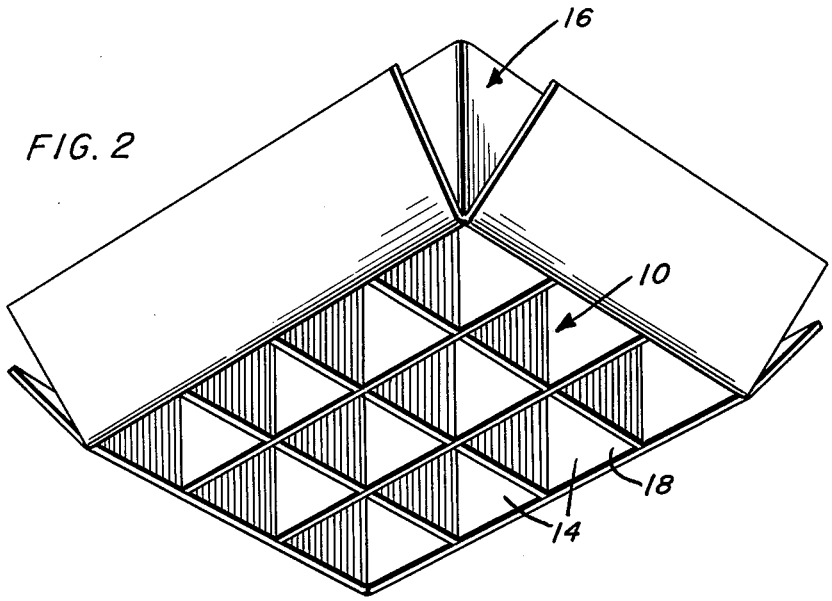
FIG. 2 is a perspective view of an inverted carton, such as during a decasing operation, with the partition of the present invention retained therein.
Figure 3:
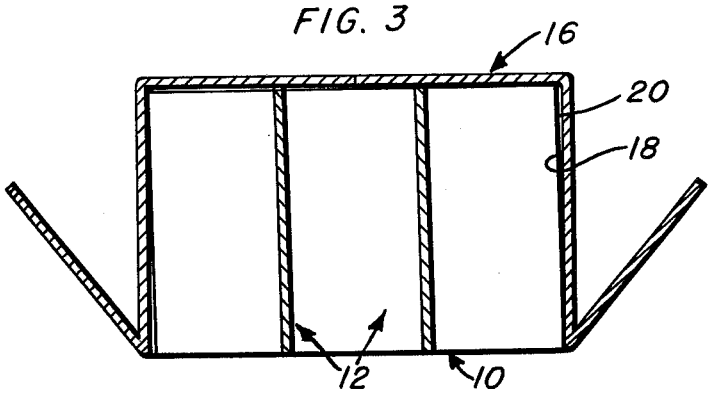
FIG. 3 is a transverse cross sectional view of a carton retained partition.

With reference to FIG. 2, it is frequently necessary to invert the carton 16 for the discharge of the contents therefrom, for example glass containers immediately prior to the filling procedure. In conjunction with, or for that matter either prior to or subsequent to, the discharge of the contents from the individual cells 14, there is a very great liklihood that the partition 10 will also either partially or completely slide from the inverted carton 16. This sliding of the partition from the carton results basically from the fact that insufficient friction is developed between the smooth interior surfaces 18 of the carton wall and the smooth exterior vertical side edges 20 of the partition panel 12. While the tendency for the partition to slide from the carton during a decasing operation or the like will vary under different circumstances, both in view of the manufacturing tolerances within which the cartons and partitions are constructed and the necessity of avoiding any distortion of the cartons or cells therein by making the partitions oversized, the problem of the freely discharging partitions is significant. It is also of interest to note than even should the partition 10 cant or tilt within the carton, as suggested in FIG. 3, the smooth engaging surfaces will normally still be insufficient so as to prevent an outward sliding of the partition.

While, in some instances, the partitions can be permanently affixed within the carton, such as is frequently done in some packaging environments by forming right angularly directed end portions along the vertical ends of each of the partition panels and directly adhering the ends to the interior of the carton, removal of such partitions without destruction of the carton is not possible. As such, the carton cannot be adapted for uses other than that for which it was originally intended. Further, there can be no separation and individual collapsing of the partition and carton for shipping purposes.

The present invention proposes a unique solution to the vexing problem of accidental discharge of partitions from cartons, while at the same time retaining the capability of removal of the partitions as desired. This solution is effected by the application, as by coating or the like, of a substance 22 on the opposed vertical end edges of the partition panel 12 which will result in the development of sufficient shear resistance between the edges 20 of the partition panels 12 and the inner surface or face 18 of the carton 16 as to preclude accidental sliding of the partition from the carton. At the same time, the engagement between the partition edges and the carton wall surface is to be such as to enable a ready stripping of the partition from the carton without such damage to the carton as would affect its reuse. In other words, while some fibre removal might be noted when dealing with paperboard, depending upon the nature of the substance used, there will be no ply delamination or surface disruption, and the integrity of the inner wall surface of the carton and the partition edges will be maintained. The above described example, Goodrich Chemical Company's Good-rite B-0137 2570X1, has been found to be capable of holding a partition within the carton even if only a small portion of the partition's coated edges come in contact with the inside of the carton. For example, if the carton were oversized and, as suggested in FIG. 3, in the process of decasing the partition started to move from the carton, any canting or cocking of the partition as would occur in substantially every case, would bring at least a small portion of at least one set of outside vertical edges of the partition into contact with the inside of the carton. At that point, there would be an adhering or development of sufficient friction so as to prevent a continued outward movement of the partition. This would not be the case with untreated or uncoated edges.

While the substance 22 will normally be applied to the vertical edges on either two opposing sides or all four sides of the partition, satisfactory results can be obtained by coating the edges on one of the two lengthwise sides and one of the two crosswise sides. It is also possible to coat only one side of the partition and still obtain the desired result. Further, the coating along any edge can be either continuous or discontinuous as desired. Finally, there will also exist the possibility of coating the bottom edges of the partition which would require an actual adhesive adherence rather than the development of a slide resisting frictional surface.

The substance which, when applied, will normally be liquid in nature, can be applied in any one of several ways. In the case of partitions wherein the lengthwise and crosswise strips or panels are cut from rolls of chipboard, the latex material can be applied to the outside edge of the roll using a paintbrush, paint roller or any one of several types of spraying devices. This will normally be done ten to fifteen minutes before the roll is to be used to permit drying of the material prior to cutting the strips. The material or substance can also be applied to a completely assembled partition if the strip edges have not been precoated. In the case of equipment used in the automatic assembly of fibre partitions from paperboard, the material can be applied by any of the means described above, in conjunction with sufficient drying means, to the edges of the paperboard web as the roll unwinds and is fed into the die-cutting and strip-making sections of the machine prior to automatic assembly.

Also, it is contemplated that the substance applied to the edges be colored so as to be readily distinguished. In this manner, the prepared partitions will be easily recognized both as an indication of origin and an indication of the adaptability of the partition for the above described purposes.

The foregoing is considered illustrative of the principles of the invention. Since modifications and changes may readily occur to those skilled in the art, it is not desired to limit the invention to the exact construction and operation shown and described. Accordingly, all suitable modifications and equivalents may be resorted to, falling within the scope of the invention as claimed.

I claim:

1. A partitioned container comprising a box, a partition removably received within said box, said box having an inner wall surface, said partition having vertical edge portions, top edge portions, and bottom edge portions engageable with the inner wall surfaces of the box, and a movement resisting substance primarily adhered to at least a portion of said partition vertical edge portions and releasably adhered to the inner wall surface for separation from the inner wall surface while retaining the integrity of the inner wall surface and the partition vertical edge portions.

2. The construction of claim 1 wherein said substance comprises an elastomeric substance for providing a temporary adherence of the selected ones of said edge portions to the innner surface.

3. The construction of 1 wherein said partition includes multiple crossed panels, said exposed outer edges including vertical side edges, top edges and bottom edges, said substance being on at least said vertical side edges.

4. The construction of claim 1 wherein said movement resisting substance is primarily adhered to at least a portion of said partition top edge portions.

5. The construction of claim 1 wherein said movement resisting substance is primarily adhered to at least a portion of said partition bottom edge portions.

* * * * *